US010160243B2

(12) United States Patent
Suzuki

(10) Patent No.: US 10,160,243 B2
(45) Date of Patent: Dec. 25, 2018

(54) DIGITAL PRINTING PRESS

(71) Applicant: Komori Corporation, Tokyo (JP)

(72) Inventor: Yasuhiro Suzuki, Yamagata (JP)

(73) Assignee: KOMORI CORPORATION, Tokyo (JP)

( * ) Notice: Subject to any disclaimer, the term of this patent is extended or adjusted under 35 U.S.C. 154(b) by 0 days.

(21) Appl. No.: 15/519,140

(22) PCT Filed: Oct. 5, 2015

(86) PCT No.: PCT/JP2015/078179
§ 371 (c)(1),
(2) Date: Apr. 13, 2017

(87) PCT Pub. No.: WO2016/059994
PCT Pub. Date: Apr. 21, 2016

(65) Prior Publication Data

US 2017/0239967 A1 Aug. 24, 2017

(30) Foreign Application Priority Data

Oct. 16, 2014 (JP) ..... 2014-211405

(51) Int. Cl.
*B41J 2/01* (2006.01)
*B41J 29/38* (2006.01)
(Continued)

(52) U.S. Cl.
CPC ..... *B41J 29/38* (2013.01); *B41J 2/01* (2013.01); *B41J 11/42* (2013.01); *B41J 13/0027* (2013.01); *B65H 7/06* (2013.01); *B41J 13/223* (2013.01)

(58) Field of Classification Search
CPC ..... B41J 29/38; B41J 2/01; B41J 11/04; B41J 11/42
(Continued)

(56) References Cited

U.S. PATENT DOCUMENTS 5,815,766 A * 9/1998 Miller ..... G03G 15/70 271/259
8,727,469 B2 5/2014 Hattori et al.
(Continued)

FOREIGN PATENT DOCUMENTS

EP 2657035 A1 10/2013
JP H10-095147 A 4/1998
(Continued)

OTHER PUBLICATIONS

Supplementary European Search Report and Written Opinion received for EP Patent Application No. 15850370.6, dated Jun. 26, 2018, 4 pages.

*Primary Examiner* — Huan Tran
*Assistant Examiner* — Alexander D Shenderov
(74) *Attorney, Agent, or Firm* — Womble Bond Dickinson (US) LLP

(57) ABSTRACT

A digital printing press including a printing cylinder configured to transport a sheet, a driving device (41) configured to drive the printing cylinder, an encoder (44) configured to detect the phase of the printing cylinder, and first to fourth inkjet nozzle heads (23-26). The digital printing press further includes a floating detector (22) and configured to detect an abnormality of the sheet, and a control device (28) configured to control an operation of the driving device (41). The control device (28) stops the driving device (41) when the floating detector (22) detects a floating portion. The control device (28) operates the driving device (41) based on the phase of the printing cylinder when the floating detector (22) detects the floating portion and when the driving device (41) stops after floating detection and moving the floating portion detected by the floating detector (22) to a predetermined confirmation position.

4 Claims, 4 Drawing Sheets

(51) Int. Cl.

| | |
|---|---|
| ***B41J 11/42*** | (2006.01) |
| ***B65H 7/06*** | (2006.01) |
| ***B41J 13/00*** | (2006.01) |
| *B41J 13/22* | (2006.01) |

(58) Field of Classification Search
USPC ..... 347/19
See application file for complete search history.

(56) References Cited

U.S. PATENT DOCUMENTS

| | | | | |
|---|---|---|---|---|
| 9,307,098 | B2 * | 4/2016 | Mizutani | H04N 1/00092 |
| 2013/0278665 | A1 * | 10/2013 | Imamura | B41J 13/0009 347/16 |
| 2013/0278669 | A1 * | 10/2013 | Hamamoto | B41J 29/393 347/19 |

FOREIGN PATENT DOCUMENTS

| | | | |
|---|---|---|---|
| JP | H10-235976 | A | 9/1998 |
| JP | 2010-111474 | A | 5/2010 |
| JP | 2011-195221 | A | 10/2011 |
| JP | 2012-166347 | A | 9/2012 |

* cited by examiner

DIGITAL PRINTING PRESS

TECHNICAL FIELD

The present invention relates to a digital printing press that performs digital printing on a sheet.

BACKGROUND ART

As a conventional digital printing press, there exists an inkjet type described in, for example, patent literature 1. In the digital printing press disclosed in patent literature 1, a sheet rotates together with a printing cylinder and is thus transported between an inkjet nozzle head (to be simply referred to as an inkjet head hereinafter) and the printing cylinder.

Printing is performed by ejecting ink from the inkjet head to the sheet in a state in which the sheet is located between the printing cylinder and the inkjet head. To obtain high print quality, the inkjet head is arranged at a position where a small gap is formed with respect to the sheet. For this reason, if the sheet partially floats up from the printing cylinder, the distance between the sheet and the inkjet head changes to cause a print error. Additionally, the floating portion may contact the inkjet head, and the inkjet head may be damaged.

To prevent such an error, the conventional digital printing press includes a floating detector configured to detect a portion of a sheet floating from the printing cylinder.

The conventional digital printing press including an abnormality detector like the floating detector employs an arrangement that stops a motor for driving the printing cylinder and stops the printing cylinder upon detecting an abnormality during printing.

RELATED ART LITERATURE

Patent Literature

Patent Literature 1: Japanese Patent Application No. 2011-195221

DISCLOSURE OF INVENTION

Problem to be Solved by the Invention

Because an inertial force acts, the printing cylinder slightly rotates by inertia during the time after an abnormality is detected during printing, and the drive motor stops until the printing cylinder comes to rest. For this reason, the abnormality occurrence portion can hardly be specified, and the time needed to cope with the abnormality or track down the cause of the abnormality becomes long.

The present invention has been made to solve the above-described problem, and has as its object to provide a digital printing press capable of quickly specifying an abnormality occurrence portion detected during printing.

Means of Solution to the Problem

In order to achieve the above-described object, according to the present invention, there is provided a digital printing press comprising a printing cylinder configured to hold and transport a sheet, a driving device configured to drive the printing cylinder, a phase detector configured to output detection data specifiable a phase of the printing cylinder, an inkjet nozzle head provided at a position facing the printing cylinder and configured to print the sheet, an abnormality detector provided at a position facing the printing cylinder and configured to detect an abnormality of one of the printing cylinder and the sheet, and a control device configured to control an operation of the driving device, wherein the control device includes a function of stopping the driving device when the abnormality detector detects the abnormality, and a function of operating the driving device based on the phase of the printing cylinder when the abnormality detector detects the abnormality and the phase of the printing cylinder when the driving device stops after abnormality detection and moving an abnormality occurrence portion detected by the abnormality detector to a predetermined confirmation position.

Effect of the Invention

According to the present invention, after the abnormality detector detects an abnormality, the printing cylinder stops, and the abnormality occurrence portion moves to a predetermined confirmation position. The abnormality occurrence portion can be searched for in a state in which the position of the abnormality occurrence portion is approximately estimated. It is therefore possible to easily find the abnormality occurrence portion.

Hence, according to the present invention, it is possible to provide a digital printing press capable of quickly specifying an abnormality occurrence portion detected during printing.

BEST MODE FOR CARRYING OUT THE INVENTION

A digital printing press according to an embodiment of the present invention will now be described in detail with reference to FIGS. 1 to 4.

Figure 1:
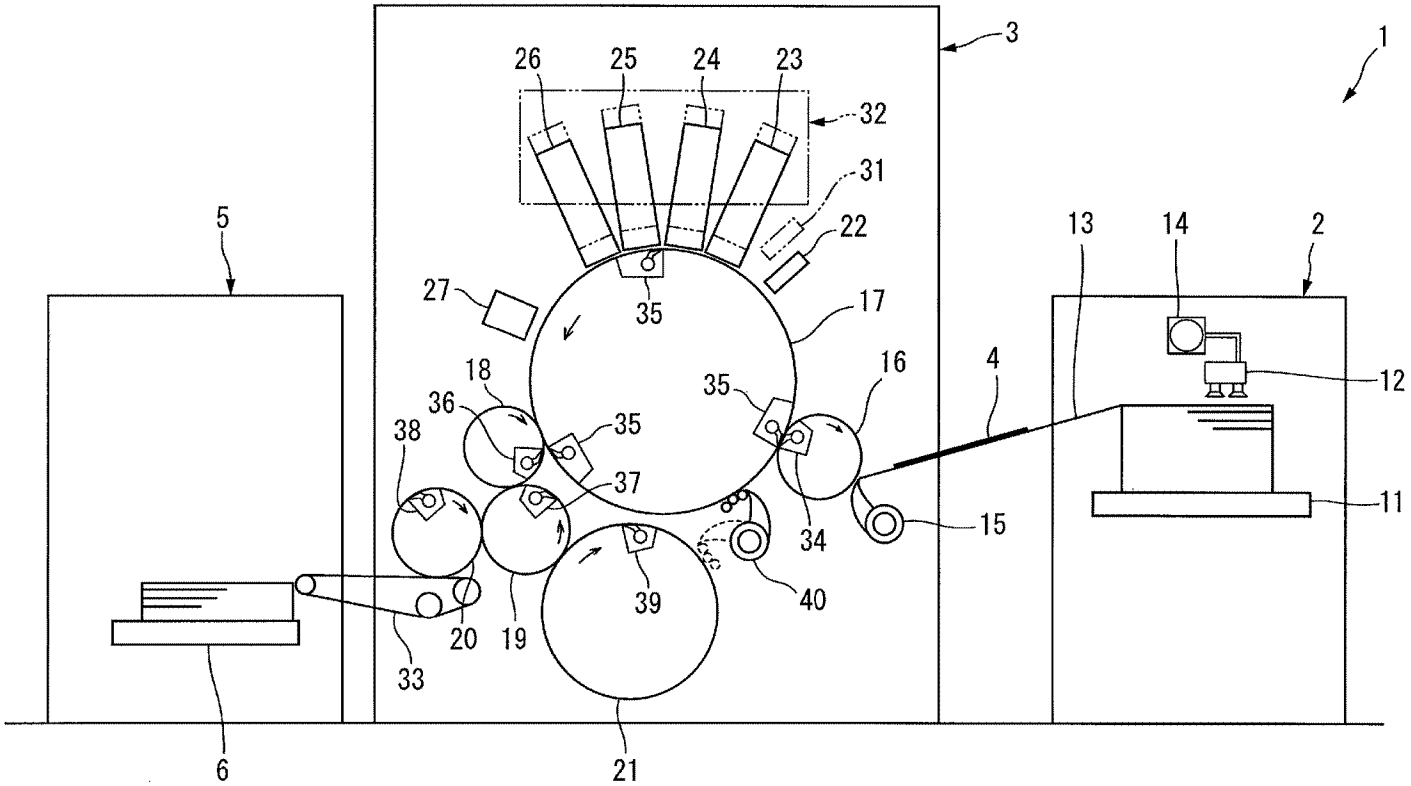
FIG. 1 is a side view showing the arrangement of a digital printing press according to the present invention.

In a digital printing press 1 shown in FIG. 1, a sheet 4 is transported from a feeder unit 2 located at the rightmost position in FIG. 1 to a print unit 3, and the print unit 3 prints one surface or both surfaces of the sheet 4. The sheet 4 printed by the print unit 3 is fed to a delivery unit 5 and discharged to a delivery pile 6.

The feeder unit 2 involves a mechanism to transfer the sheet 4 from a feeder pile 11 to a feeder board 13 by a sucker 12. The sucker 12 is connected to an intermittent feeder valve 14, and operates in one of a mode to continuously feed the sheet 4 and a mode to intermittently feed the sheet 4. To print only the obverse surface of the sheet 4, the sucker 12 continuously feeds the sheet 4 to the feeder board 13. On the other hand, to print the obverse surface and the reverse surface of the sheet 4, the sucker 12 intermittently feeds the sheet 4 to the feeder board 13.

The print unit 3 includes a feeder-side transfer cylinder 16 to which the sheet 4 supplied from the feeder unit 2 is transported by a feeder-side swing device 15, a printing cylinder 17 to which the sheet 4 is fed from the feeder-side transfer cylinder 16, and a plurality of transport cylinders 18 to 21 to which the sheet 4 after printing is fed. Although details are not illustrated, the printing cylinder 17 involves a mechanism to suck and hold the sheet 4. The print unit 3 also includes a floating detector 22 located on the downstream side of the feeder-side transfer cylinder 16 in the transportation direction, first to fourth inkjet nozzle heads 23 to 26 located on the downstream side of the floating detector 22 in the transportation direction, and an ink drying lamp 27 located on the downstream side of the fourth inkjet nozzle head 26 in the transportation direction.

The floating detector 22 detects a portion of the sheet 4 sucked and transported by the printing cylinder 17, the portion which is separated from the surface of the printing cylinder 17. The portion of the sheet 4 separated from the surface of the printing cylinder 17 will simply be referred to as a "floating portion" hereinafter. The floating detector 22 can be formed from a noncontact detector including a photoelectric sensor, a contact detector including a contactor (not shown) that comes into contact with the sheet 4, or the like.

Figure 2:
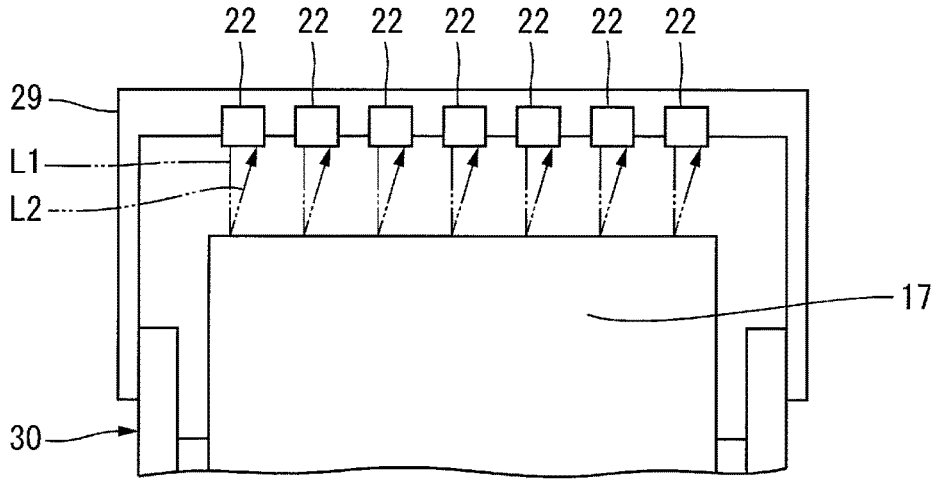
FIG. 2 is a front view for explaining the arrangement of a floating detector.

The floating detector 22 according to this embodiment detects a floating portion of the sheet 4 and sends the detection result as detection data to a control device 28 (see FIG. 3) to be described later. If the floating detector 22 is formed from a noncontact detector, a plurality of floating detectors 22 are arranged at positions facing the outer surface of the printing cylinder 17, as shown in FIG. 2. The floating detectors 22 each irradiate the printing cylinder 17 (sheet 4) with irradiation light L1, and detect light L2 reflected by the sheet 4, thereby measuring the interval between the surface of the sheet 4 and the floating detector 22.

The floating detectors 22 are arranged at a predetermined interval in the axial direction (the horizontal direction in FIG. 2) of the printing cylinder 17 and, in this state, supported by a frame 30 via a bracket 29. The frame 30 rotatably supports the printing cylinder 17 and the transport cylinders 18 to 21. In this embodiment, the floating detector 22 corresponds to "abnormality detector" of the present invention. Note that if a heater (not shown) configured to heat the sheet 4 is provided, the abnormality detector of the present invention can be formed by a temperature detector 31 (see FIG. 1). The sheet 4 is heated to improve print quality. In the digital printing press including the heater, the temperature detector 31 is provide at a position facing the printing cylinder 17 to measure the surface temperature of the sheet 4 or the surface temperature of the printing cylinder 17.

The first to fourth inkjet nozzle heads 23 to 26 each eject ink and make it adhere to the sheet 4.

The first to fourth inkjet nozzle heads 23 to 26 according to this embodiment are supported by a head moving device 32. The head moving device 32 moves the first to fourth inkjet nozzle heads 23 to 26 between a print position close to the printing cylinder 17 and a separate position separated from the printing cylinder 17. As the head moving device 32, for example, the same device as described in Japanese Patent Laid-Open No. 2013-248879 can be used.

In FIG. 1, the first to fourth inkjet nozzle heads 23 to 26 located at the print position are indicated by solid lines. When moving to the separate position, the first to fourth inkjet nozzle heads 23 to 26 move to positions indicated by alternate long and two short dashed lines.

The operation of the head moving device 32 is controlled by the control device 28 (to be described later).

The ink drying lamp 27 cures the ink applied to the sheet 4 by the first to fourth inkjet nozzle heads 23 to 26.

The plurality of transport cylinders described above include the first discharge-side transfer cylinder 18 that receives the sheet 4 from the printing cylinder 17, the second discharge-side transfer cylinder 19 that receives the sheet 4 from the first discharge-side transfer cylinder 18, and the delivery cylinder 20 and the pre-reversal double-size cylinder 21 both of which receive the sheet 4 from the second discharge-side transfer cylinder 19. The sheet 4 whose reverse surface should be printed is transported from the second discharge-side transfer cylinder 19 to the pre-reversal double-size cylinder 21. The sheet 4 whose obverse surface should only be printed or the sheet 4 with the obverse and reverse surfaces printed is fed from the second discharge-side transfer cylinder 19 to the delivery cylinder 20 and fed to the delivery pile 6 via a delivery belt 33.

The feeder-side transfer cylinder 16, the printing cylinder 17, the first discharge-side transfer cylinder 18, the second discharge-side transfer cylinder 19, the delivery cylinder 20, and the pre-reversal double-size cylinder 21 include gripper devices 34 to 39, respectively, to transfer the sheet 4. The gripper devices 34 to 39 each have a conventionally known structure to grip and hold the leading edge of the sheet 4 in the feeding direction. The gripper device 35 of the printing cylinder 17 is provided at each of positions dividing the outer surface of the printing cylinder 17 into three equal parts.

A reversing swing device 40 configured to feed the sheet 4 from the pre-reversal double-size cylinder 21 to the printing cylinder 17 is arranged between the pre-reversal double-size cylinder 21 and the feeder-side transfer cylinder 16. The reversing swing device 40 grips the trailing edge of the sheet 4 in the feeding direction, the portion which is fed by the pre-reversal double-size cylinder 21, and feeds the sheet 4 to the printing cylinder 17 in a state in which the obverse surface faces the printing cylinder 17.

Figure 3:
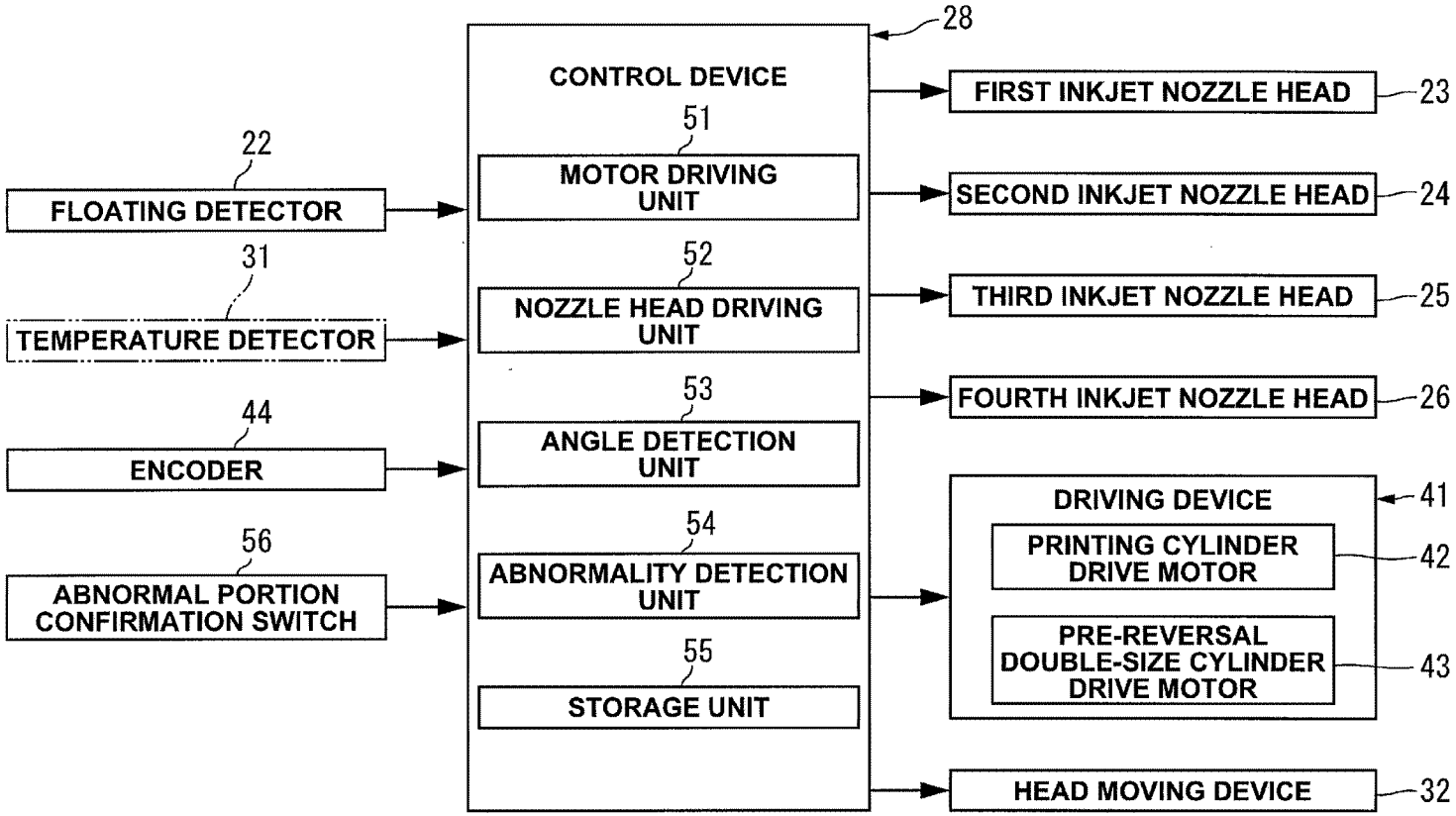
FIG. 3 is a block diagram showing the arrangement of the control device of the digital printing press according to the present invention.

The plurality of cylinders 16 to 21 and the two swing devices 15 and 40 included in the print unit 3 are driven by a driving device 41 (see FIG. 3). The driving device 41 includes a printing cylinder drive motor 42 configured to drive the plurality of transport cylinders 16 to 21, including the printing cylinder 17, and a pre-reversal double-size cylinder drive motor 43 configured to drive only the pre-reversal double-size cylinder 21. The operation of the driving device 41 is controlled by the control device 28. The driving device 41 also includes an encoder 44 that detects the angle of rotation of the printing cylinder drive motor 42. The encoder 44 sends the angle of rotation of the printing cylinder drive motor 42 as detection data to the control device 28. In this embodiment, the encoder 44 corresponds to "phase detector" of the present invention.

The control device 28 is configured to control the operation of the digital printing press 1, and includes a motor driving unit 51, a nozzle head driving unit 52, an angle detection unit 53, an abnormality detection unit 54, and a storage unit 55. An abnormal portion confirmation switch 56 to be artificially operated is connected to the control device 28.

When the digital printing press 1 performs printing, the motor driving unit 51 operates the driving device 41 to obtain a predetermined print speed. If the abnormality detection unit 54 (to be described later) detects an abnormality, the motor driving unit 51 operates the driving device 41 in accordance with a predetermined control procedure at the time of abnormality detection.

When the digital printing press 1 performs printing, the nozzle head driving unit 52 operates the first to fourth inkjet nozzle heads 23 to 26 and also operates the ink drying lamp 27. If the abnormality detection unit 54 (to be described later) detects an abnormality, the nozzle head driving unit 52 operates the head moving device 32 to move the first to fourth inkjet nozzle heads 23 to 26 to the separate position.

The angle detection unit 53 detects the angle of rotation of the printing cylinder 17 based on output data of the encoder 44. That is, the output data of the encoder 44 is data specifiable the phase of the printing cylinder 17.

The abnormality detection unit 54 detects, as an abnormality, a case in which the height (floating amount) of a floating portion of the sheet 4 detected by the floating detector 22 is more than a predetermined determination value. The abnormality detection unit 54 according to this embodiment stores the angle of rotation of the printing cylinder 17 upon detecting an abnormality in the storage unit 55. The angle of rotation of the printing cylinder 17 is a value detected by the angle detection unit 53.

The abnormal portion confirmation switch 56 is configured to execute part of the control procedure at the time of abnormality detection according to this embodiment. The control procedure at the time of abnormality detection will be described here with reference to the flowchart of FIG. 4.

Figure 4:
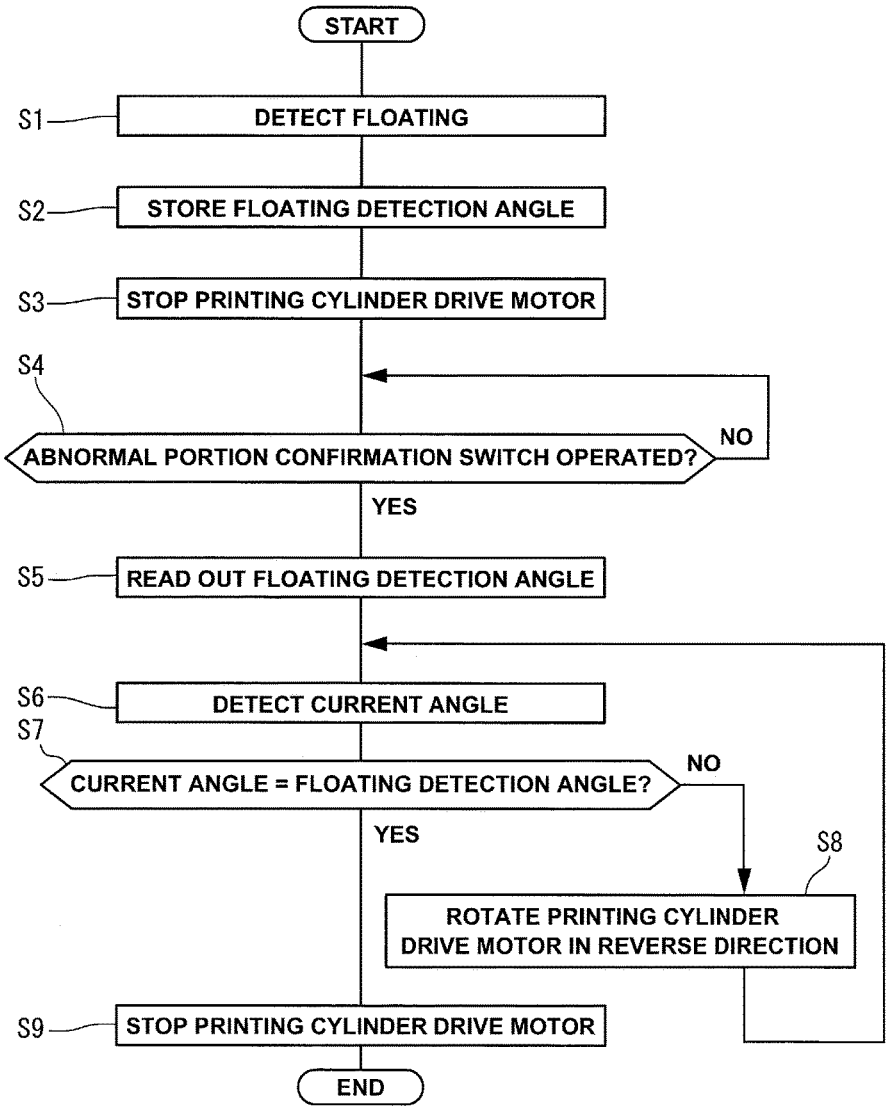
FIG. 4 is a flowchart for explaining a control procedure at the time of abnormality detection.

Control at the time of abnormality detection is started by detecting a floating portion of the sheet 4 by the floating detector 22 in step S1 of the flowchart shown in FIG. 4. Note that for the sake of convenience, a description will be made here assuming a state in which the floating detector 22 detects a floating portion whose height is detected by the abnormality detection unit 54 of the control device 28 as an abnormality.

If the floating detector 22 detects the floating portion of the sheet 4, in step S2, the control device 28 stores the angle of rotation (phase) of the printing cylinder 17 at the time of floating detection. Note that in FIG. 4, the angle of rotation of the printing cylinder 17 at the time of floating detection is simply described as "floating detection angle". In step S3, the control device 28 stops power supply to the printing cylinder drive motor 42 and the pre-reversal double-size cylinder drive motor 43 of the driving device 41 and stops the driving device 41. That is, the control device 28 includes a function of stopping the driving device 41 when the floating detector 22 (abnormality detector) detects a floating portion (abnormality).

The printing cylinder drive motor 42 of the driving device 41 rotates the printing cylinder 17 and the plurality of transport cylinders 16 to 20 at a high speed during printing. Hence, because an inertial force acts, each of the printing cylinder 17 and the plurality of transport cylinders 16 to 20 rotates by inertia by a predetermined angle after the stop of power supply to the driving device 41, and then stops and comes to rest.

The control device 28 stops the driving device 41 as described above, and after that, stands by until the abnormal portion confirmation switch 56 is operated, as indicated by step S4. During the standby time, an inspection operation of the printing cylinder 17 by the operator (not shown) can be executed.

When the abnormal portion confirmation switch 56 is operated, the control device 28 reads out the angle of rotation of the printing cylinder 17 from the storage unit 55 in step S5, and detects the current angle of rotation (phase) of the printing cylinder 17 in step S6. Note that in FIG. 4, the current angle of rotation of the printing cylinder 17 is simply described as "current angle".

In step S7, the control device 28 determines whether the current angle of rotation of the printing cylinder 17 matches the angle of rotation at the time of floating detection. If the current angle of rotation does not equal the angle of rotation at the time of floating detection, the process advances to step S8. The control device 28 rotates the printing cylinder drive motor 42 by a predetermined angle in a reverse direction. The process then returns to step S6 to detect the current angle of the printing cylinder 17.

The return operation of rotating the printing cylinder drive motor 42 in the reverse direction is performed until the current angle of rotation of the printing cylinder 17 matches the angle of rotation at the time of floating detection. If the current angle of rotation matches the angle of rotation at the time of floating detection, the control device 28 stops the printing cylinder drive motor 42 (step S9). As described above, by rotating the printing cylinder 17 in the reverse direction, the floating portion of the sheet 4 is located at a position facing the floating detector 22.

That is, the control device 28 includes a function of operating the driving device 41 based on the angle of rotation (phase) of the printing cylinder 17 when the floating detector 22 detects the floating portion and the angle of rotation (phase) of the printing cylinder 17 when the driving device 41 stops after the floating detection and moving the floating portion (abnormality occurrence portion) detected by the floating detector 22 to a position facing the floating detector 22. In this embodiment, the position facing the floating detector 22 corresponds to "predetermined confirmation position" of the present invention.

For this reason, if the control at the time of abnormality detection is executed, the printing cylinder 17 stops after the floating detector 22 detects the floating portion of the sheet 4. When the abnormal portion confirmation switch 56 is operated, the floating portion moves to the position facing the floating detector 22. According to this embodiment, since the floating portion can be searched for in a state in which the position of the floating portion is approximately estimated, it is possible to easily find the floating portion.

Hence, according to this embodiment, it is possible to provide a digital printing press capable of quickly specifying a floating portion detected during printing. Note that if the temperature detector 31 is used in place of the floating detector 22, a digital printing press capable of easily finding an abnormal portion where the temperature of the printing cylinder 17 or sheet 4 is abnormal can be provided.

The abnormality detector according to this embodiment is formed from the floating detector 22 that detects a portion of the sheet 4 transported by the printing cylinder 17, the portion which is separated from the surface of the printing cylinder 17.

For this reason, according to this embodiment, it is possible to quickly specify an abnormality occurrence portion where the interval between the sheet 4 and the first to fourth inkjet nozzle heads 23 to 26 is narrower than a predetermined interval. Hence, according to this embodiment, it is possible to provide a digital printing press in which no print error is caused by contact between the sheet 4 and the first to fourth inkjet nozzle heads 23 to 26, and the first to fourth inkjet nozzle heads 23 to 26 are not damaged by the contact with the sheet 4.

The digital printing press 1 according to this embodiment includes the abnormal portion confirmation switch 56 to be artificially operated. The control device 28 according to this embodiment starts the operation of locating the floating portion at the position (confirmation position) facing the floating detector 22 when the abnormal portion confirmation switch 56 is operated in a state in which the floating detector 22 detects the floating portion of the sheet 4, and the driving device 41 is at rest.

For this reason, the operator can designate the time to rotate the printing cylinder 17 such that the floating portion is located at the position facing the floating detector 22. That is, after the floating of the sheet 4 is detected, and the printing cylinder 17 stops, the printing cylinder 17 can be operated after safety check.

Hence, according to this embodiment, it is possible to provide a digital printing press capable of preventing a new error from occurring when the printing cylinder 17 rotates again in a state in which an abnormality has occurred.

The digital printing press 1 according to this embodiment includes the head moving device 32 that moves the first to fourth inkjet nozzle heads 23 to 26 between the print position close to the printing cylinder 17 and the separate position separated from the printing cylinder 17. The head moving device 32 is configured to move the first to fourth inkjet nozzle heads 23 to 26 from the print position to the separate position when the floating detector 22 detects an abnormality.

It is therefore possible to prevent the floating portion of the sheet 4 from coming into contact with the first to fourth inkjet nozzle heads 23 to 26 and damaging the first to fourth inkjet nozzle heads 23 to 26 during the time after power supply to the printing cylinder drive motor 42 is stopped until the printing cylinder 17 comes to rest. In addition, the first to fourth inkjet nozzle heads 23 to 26 separate from the sheet 4 or the printing cylinder 17, and the sheet 4 or the printing cylinder 17 can be easily visually recognized. Hence, the floating portion of the sheet 4 can be specified more quickly.

The confirmation position according to this embodiment is the position facing the floating detector 22. Hence, according to this embodiment, since the situation at the time of abnormality detection can easily be reproduced, the abnormality occurrence portion can be specified more easily. Note that the confirmation position can be changed as needed as long as it is a position where the portion of the sheet 4 facing the floating detector 22 at the time of floating detection can be easily visually recognized. If the position that can be easily visually recognized is located on the downstream side of the fourth inkjet nozzle head 26 in the transportation direction of the sheet 4, the printing cylinder 17 rotates by a predetermined angle after the abnormal portion confirmation switch 56 is operated.

EXPLANATION OF THE REFERENCE NUMERALS AND SIGNS

1 . . . digital printing press, 4 . . . sheet, 17 . . . printing cylinder, 22 . . . floating detector, 23 . . . first inkjet nozzle head, 24 . . . second inkjet nozzle head, 25 . . . third inkjet nozzle head, 26 . . . fourth inkjet nozzle head, 28 . . . control device, 41 . . . driving device, 44 . . . encoder (phase detector).

The invention claimed is:

1. A digital printing press comprising:

a printing cylinder configured to hold and transport a sheet;

a driving device configured to drive the printing cylinder;

a phase detector configured to output detection data specifiable a phase of the printing cylinder;

an inkjet nozzle head provided at a position facing the printing cylinder and configured to print the sheet;

an abnormality detector provided at a position facing the printing cylinder and configured to detect an abnormality of one of the printing cylinder and the sheet;

a switch; and a control device configured to control an operation of the driving device, wherein the control device includes a function of stopping the driving device when the abnormality detector detects the abnormality, a function of operating the driving device based on the phase of the printing cylinder when the abnormality detector detects the abnormality and the phase of the printing cylinder when the driving device stops after abnormality detection and moving an abnormality occurrence portion detected by the abnormality detector to a predetermined confirmation position by rotating the printing cylinder in a reverse direction, and a function of starting an operation of locating the abnormality occurrence portion at the confirmation position when the switch is operated in a state in which the abnormality detector detects the abnormality, and the driving device is at rest.

2. The digital printing press according to claim 1, wherein the abnormality detector detects a portion of the sheet transported by the printing cylinder, the portion which is separated from a surface of the printing cylinder.

3. The digital printing press according to claim 2, further comprising a head moving device configured to move the inkjet nozzle head between a print position close to the printing cylinder and a separate position separated from the printing cylinder, wherein the head moving device moves the inkjet nozzle head from the print position to the separate position when the abnormality detector detects the abnormality.

4. The digital printing press according to claim 1, wherein the confirmation position is a position facing the abnormality detector.

* * * * *